US012742265B2

(12) United States Patent
Izawa et al.

(10) Patent No.: US 12,742,265 B2
(45) Date of Patent: Sep. 22, 2026

(54) PILE YARN FOR TOWEL CLOTH, MANUFACTURING METHOD THEREOF, TOWEL CLOTH, AND MANUFACTURING METHOD THEREOF

(71) Applicant: IZAWA TOWEL CO., LTD., Tokyo (JP)

(72) Inventors: Shoji Izawa, Tokyo (JP); Ayaka Sekitani, Tokyo (JP)

(73) Assignee: IZAWA TOWEL CO., LTD., Tokyo (JP)

( * ) Notice: Subject to any disclaimer, the term of this patent is extended or adjusted under 35 U.S.C. 154(b) by 0 days.

(21) Appl. No.: 19/134,772

(22) PCT Filed: Aug. 26, 2024

(86) PCT No.: PCT/JP2024/030212
§ 371 (c)(1),
(2) Date: Jun. 2, 2025

(87) PCT Pub. No.: WO2025/248801
PCT Pub. Date: Dec. 4, 2025

(65) Prior Publication Data

US 2026/0009168 A1 Jan. 8, 2026

(30) Foreign Application Priority Data

May 31, 2024 (JP) ..... 2024-089513

(51) Int. Cl.
*D03D 15/41* (2021.01)
*D02G 3/02* (2006.01)
(Continued)

(52) U.S. Cl.
CPC ..... *D02G 3/36* (2013.01); *D02G 3/02* (2013.01); *D02G 3/44* (2013.01); *D03D 15/217* (2021.01);
(Continued)

(58) Field of Classification Search
CPC ..... D03D 15/41; D03D 15/14; D03D 15/283; D03D 15/217; D02G 3/36; D02G 3/02
See application file for complete search history.

(56) References Cited

U.S. PATENT DOCUMENTS 2,371,199 A * 3/1945 Walliser ..... D03D 27/06 139/402
4,202,382 A * 5/1980 Westhead ..... D03D 15/283 442/205
(Continued)

FOREIGN PATENT DOCUMENTS

CN 1441097 A 9/2003
CN 201971947 U 9/2011
(Continued)

OTHER PUBLICATIONS

Office Action issued in JP 2024-089513; mailed by the Japanese Patent Office on Aug. 6, 2024.

*Primary Examiner* — Tajash D Patel
(74) *Attorney, Agent, or Firm* — Studebaker Brackett PLLC

(57) ABSTRACT

A warp pile yarn 14 to be used for a towel cloth including a pile yarn, a warp ground yarn, and a weft ground yarn is a sheath-core spun yarn 10 in which a core fiber is twisted in one direction, while a sheath fiber is arranged parallel to a yarn axis. The sheath-core spun yarn 10 is twisted together with a water-soluble fiber yarn 13, and a direction in which the water-soluble fiber yarn 13 is wound is reverse to a direction in which the core fiber is twisted. By way of example, the pile yarn 14 is an air-spun yarn.

9 Claims, 4 Drawing Sheets

(51) Int. Cl.

| | |
|---|---|
| ***D02G 3/36*** | (2006.01) |
| ***D02G 3/44*** | (2006.01) |
| ***D03D 15/217*** | (2021.01) |
| ***D03D 15/283*** | (2021.01) |
| ***D03D 27/08*** | (2006.01) |

(52) U.S. Cl.
CPC ..... *D03D 15/283* (2021.01); *D03D 15/41* (2021.01); *D03D 27/08* (2013.01); *D10B 2201/02* (2013.01); *D10B 2321/06* (2013.01); *D10B 2503/00* (2013.01)

(56) References Cited

U.S. PATENT DOCUMENTS

| | | | | |
|---|---|---|---|---|
| 2007/0087162 | A1* | 4/2007 | Mandawewala | D02G 3/36 428/95 |
| 2018/0347080 | A1* | 12/2018 | Goenka | D03D 15/54 |
| 2019/0186054 | A1* | 6/2019 | Debnath | D02G 3/04 |
| 2023/0203723 | A1 | 6/2023 | Izawa | |
| 2023/0383444 | A1* | 11/2023 | Budd | D02G 3/025 |
| 2024/0263366 | A1 | 8/2024 | Izawa | |

FOREIGN PATENT DOCUMENTS

| | | | | | |
|---|---|---|---|---|---|
| CN | 101591829 | B | | 8/2012 | |
| JP | S57-193538 | A | | 11/1982 | |
| JP | 2005-213661 | A | | 8/2005 | |
| JP | 4393357 | B2 | | 1/2010 | |
| JP | 2017155397 | A | * | 9/2017 | |
| JP | 2018-057499 | A | | 4/2018 | |
| JP | 2018-188783 | A | | 11/2018 | |
| JP | 2021050462 | A | * | 4/2021 | D03D 15/217 |
| JP | 2021107610 | A | * | 7/2021 | D02G 3/281 |
| JP | 6968464 | B2 | | 11/2021 | |
| JP | 7141770 | B1 | | 9/2022 | |
| WO | 2019/130579 | A1 | | 7/2019 | |
| WO | 2023/074347 | A1 | | 5/2023 | |

* cited by examiner

PILE YARN FOR TOWEL CLOTH, MANUFACTURING METHOD THEREOF, TOWEL CLOTH, AND MANUFACTURING METHOD THEREOF

TECHNICAL FIELD

The present invention relates to a pile yarn for towel cloth using an air-spun yarn, a manufacturing method thereof, a towel cloth, and a manufacturing method thereof.

BACKGROUND ART

Conventionally, a towel cloth has been basically made of a pile woven fabric by using a pile yarn, a warp ground yarn, and a weft ground yarn. In addition, to allow a towel cloth to have improved water absorbency, a basis weight (mass per unit area) of the towel cloth is set relatively high, and thick yarns each having a high fineness are used as constituent yarns thereof.

In Patent Documents 1 to 2, it is proposed to size each of a pile yarn and a warp ground yarn. In Patent Documents 3 and 4, the present inventor proposes a pile yarn for towel cloth using a fasciated spun yarn (air-spun yarn).

CITATION LIST

Patent Document

Patent Document 1: Patent Publication JP-A-2018-188783
Patent Document 2: Patent Publication JP-A-2018-057499
Patent Document 3: Japanese Patent No. 6968464
Patent Document 4: Japanese Patent No. 7141770

SUMMARY

Technical Problem

However, in a case of the prior-art ring spun yarn described above, inner fibers and outer fibers are uniformly twisted and, even when the inner fibers and outer fibers are untwisted to provide a non-twisted yarn, the inner fibers and the outer fibers are brought into a uniformly loose state to result in problems of a low strength and incidence of increased fluff. Meanwhile, in a case of the fasciated spun yarn (air-spun yarn), it is typical that inner fibers are loose and outer fibers are tightly wound therearound to result in a problem of a hard texture.

As a result of diligent study conducted to allow optimal use of characteristic features for a towel cloth, the present invention provides a pile yarn for towel cloth having less fluff dropping, bulky, less likely to lose puffiness after washing, having less rewetting, and permitting comfortable wiping experience, a manufacturing method thereof, and a manufacturing method of a towel cloth using the same.

Solution to Problem

An embodiment of the present invention relates to a pile yarn for towel cloth which is a pile yarn to be used for a towel cloth including a pile yarn, a warp ground yarn, and a weft ground yarn, wherein the pile yarn is a sheath-core spun yarn in which a core fiber is twisted in one direction, while a sheath fiber is arranged parallel to a yarn axis, and the sheath-core spun yarn is twisted together with a water-soluble fiber yarn and a direction in which the water-soluble fiber yarn is wound is reverse to the direction in which the core fiber is twisted.

Another embodiment of the present invention relates to a manufacturing method of the pile yarn for towel cloth described above, the pile yarn being manufactured by an air spinning machine as an air-spun yarn in which a core fiber is parallel to a yarn axis, while a sheath fiber is twisted in one direction, and a water-soluble fiber yarn being twisted together with a surface of the air-spun yarn in a direction reverse to a direction in which the core fiber is twisted to twist the core fiber in one direction, while the sheath fiber is untwisted to be parallel to the yarn axis.

Still another embodiment of the present invention relates to a towel cloth using the pile yarn for towel cloth described above, wherein the towel cloth is a pile woven fabric, and the pile yarn is a sheath-core spun yarn in which a core fiber is twisted in one direction, while a sheath wire is arranged parallel to a yarn axis.

Yet another embodiment of the present invention relates to a manufacturing method of a towel cloth using the pile yarn for towel cloth described above, wherein, after the pile yarn is woven to a pile woven fabric, a water-soluble fiber yarn on a surface of the pile yarn is dissolved.

A specific aspect of the present invention is as follows.

[1]

A pile yarn for towel cloth which is a pile yarn to be used for a towel cloth including a pile yarn, a warp ground yarn, and a weft ground yarn, wherein the pile yarn is a sheath-core spun yarn in which a core fiber is twisted in one direction, while a sheath fiber is arranged parallel to a yarn axis, and the sheath-core spun yarn is twisted together with a water-soluble fiber yarn and a direction in which the water-soluble fiber yarn is wound is reverse to the direction in which the core fiber is twisted.

[2]

The pile yarn for towel cloth according to [1], wherein the pile yarn is an air-spun yarn.

[3]

The pile yarn for towel cloth according to [1] or [2], wherein the core fiber and the sheath fiber are switched to each other by migration.

[4]

The pile yarn for towel cloth according to any one of [1] to [3], wherein the water-soluble fiber yarn is a water-soluble PVA yarn or a polylactic yarn.

[5]

The pile yarn for towel cloth according to any one of [1] to [4], wherein a twist multiplier K for the sheath-core spun yarn and the water-soluble fiber yarn is in excess of 0 and not more than 4.0, where the twist multiplier (K) is calculated using expression (Math. 1) below:

$$\text{Twist Multiplier } (K) = t/\sqrt{S} \qquad \text{[Math. 1]}$$

where t represents the number of twists (number/25.4 mm) and S represents a total yarn count (English cotton count) of the spun yarn and the water-soluble fiber yarn.

[6]

A manufacturing method of the pile yarn for towel cloth according to any one of [1] to [5],n the pile yarn being manufactured by an air spinning machine as an air-spun yarn in which a core fiber is parallel to a yarn axis, while a sheath fiber is twisted in one direction, and a water-soluble fiber yarn being twisted together with a surface of the air-spun yarn in a direction reverse to a direction in which the core fiber is twisted, to twist the core fiber in one direction, while the sheath fiber is untwisted to be parallel to the yarn axis.

[7]

A towel cloth using the pile yarn for towel cloth according to any one of [1] to [5], wherein the towel cloth is a pile woven fabric, and the pile yarn is a sheath-core spun yarn in which a core fiber is twisted in one direction, while a sheath wire is arranged parallel to a yarn axis.

[8]

A manufacturing method of a towel cloth using the pile yarn for towel cloth according to any one of [1] to [5], wherein, after the pile yarn is woven to a pile woven fabric, a water-soluble fiber yarn on a surface of the pile yarn is dissolved.

[9]

The manufacturing method of the towel cloth according to [8], wherein the dissolution of the water-soluble fiber yarn is performed when the pile woven fabric is scoured, bleached, and/or dyed.

Advantageous Effects of Invention

The pile yarn for towel cloth according to the aspect of the present invention is the sheath-core spun yarn in which the core fiber is twisted in the one direction, while the sheath fiber is arranged parallel to the yarn axis. Since the sheath-core spun yarn is twisted together with the water-soluble fiber yarn and the direction in which the water-soluble fiber yarn is wound is reverse to the direction in which the core fiber is twisted, it is possible to provide the towel cloth in which the core fiber is tightened, while the sheath fiber has a loose, soft, and puffy texture, which has less fluff dropping and is bulky and less likely to lose puffiness after washing, and which has less rewetting and permits comfortable wiping experience and a manufacturing method thereof.

In addition, the towel cloth according to the aspect of the present invention is the pile woven fabric and the pile yarn is the sheath-core spun yarn in which the core fiber is twisted in the one direction, while the sheath fiber is arranged parallel to the yarn axis. Therefore, it is possible to provide the towel cloth in which the core fiber is tightened, while the sheath fiber has a loose, soft, and puffy texture, which has less fluff dropping and is bulky and less likely to lose puffiness after washing, and which has less rewetting and permits comfortable wiping experience and a manufacturing method thereof.

DESCRIPTION OF EMBODIMENTS

Figure 1:
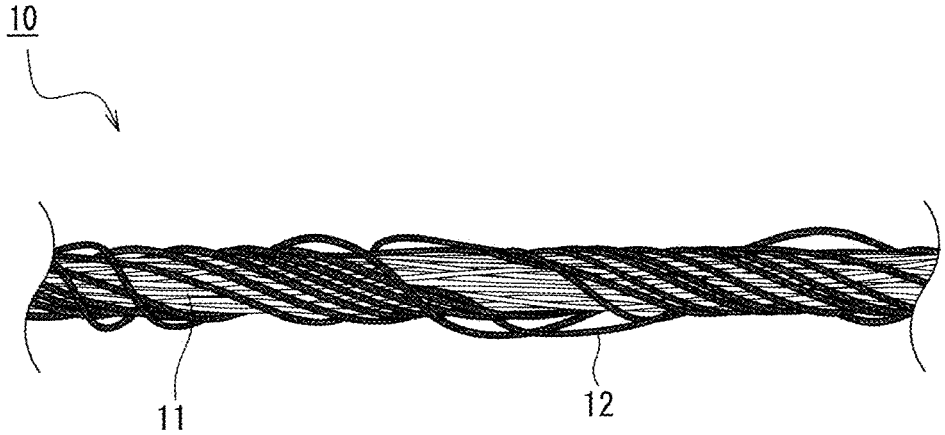
FIG. 1 is a schematic side view of an air-spun yarn to be used in an embodiment of the present invention.

The present invention has focused attention on the fact that each of pile yarns accounting for about 70% of constituent yarns of a towel cloth is an important yarn that affects functionalities such as a pile uprightness property, a texture of the towel cloth, and fluff dropping, pursued study, and obtained the following findings. In other words, the towel cloth according to an aspect of the present invention is a towel cloth which includes a warp ground yarn, a weft ground yarn, and a pile yarn and in which the pile yarn is locked to the warp ground yarn and the weft ground yarn each mentioned above. The pile yarn mentioned above is a sheath-core spun yarn in which a core fiber is twisted in one direction, while a sheath fiber is arranged parallel to a yarn axis, a water-soluble fiber yarn is wound around a surface of the sheath-core spun yarn mentioned above, and a direction in which the water-soluble fiber yarn is wound is reverse to the direction in which the core fiber mentioned above is twisted. Thus, it has been found that the towel cloth has the following advantages.

(1) When the water-soluble fiber yarn is dissolved to be removed in a subsequent step, the inner core fiber is tightened, while the outer sheath fiber is loosened. Since the inner side of the yarn is tightened, a strength thereof is not reduced even though the yarn is non-twisted. This provides a highly durable towel.

(2) The pile yarn is the sheath-core spun yarn in which the core fiber is twisted in the one direction, while the sheath fiber is arranged parallel to the yarn axis, but some of the core fibers and the sheath fibers have migrated (phenomenon in which a monofilament has entered the inside or protruded to the outside and twisted), and accordingly the core fibers and the sheath fibers are well integrated. As a result, the pile yarn has a high strength and a high durability. In addition, since the pile yarn as a whole is a non-twisted yarn or a softly twisted yarn, each of the constituent fibers thereof is present in a free state to result in a pile yarn having a satisfactory uprightness property and a soft and puffy texture. Due to the soft and puffy texture, the pile yarn can make soft contact with skin, and can efficiently wipe away sweat and moisture (texture effect, wiping effect).

(3) Since the pile yarn is a non-twisted yarn or a softly twisted yarn, the constituent fibers are easy to absorb moisture, while puffiness thereof simultaneously activates air movement to increase air permeability (water absorbency effect, air permeability effect).

(4) Due to intertwining of the constituent fibers, fluff dropping can be reduced (fluff dropping reducing effect), there is little texture change after washing, and an initial soft and puffy texture is maintained (texture washing durability effect).

Preferably, the pile yarn is an air-spun yarn (referred to also as a fasciated spun yarn). The air-spun yarn is a uniform yarn with a low fluff count, has a robust yarn structure, has high resistance to squeezing, and can be woven into a towel cloth with no sizing. In addition, a yarn speed (winding speed) is 300 to 500 m/minute, and a productivity thereof is about 10 to 30 times higher than that of a ring spinning machine.

Preferably, a fineness of the pile yarn is in a cotton count (S, single yarn) range of 10 to 50S (118 to 591 decitex). When the fineness of the pile yarn is in this range, the resulting towel cloth has an excellent texture. Examples of cotton preferable for the pile yarn are super-long-staple cotton and long-staple cotton which are shown below in Table 1.

TABLE 1

| Name | Cotton-Producing Country | Cotton Variety | Average Fiber Length (mm) | Micronaire (μg/inchi) |
|---|---|---|---|---|
| Super-Long-Staple Cotton | Barbados | Sea Island Cotton | 44.5 | 3.1 |
| | Egypt | Giza 70 | 36.5 | 4.0 |
| | Egypt | Giza 88 | 35.3 | 3.9 |
| | China | Xinjiang T/146 | 38.1 | 4.0 |
| | USA | American Pima | 36.5 | 4.1 |
| | Peru | Peruvian Pima | 36.5 | 3.5 |
| | India | Spin | 41.5 | 3.1 |
| | India | DHC-32 | 34.8 | 3.0 |
| Long-Staple Cotton | Peru | Tangis | 30.2 | 5.8 |
| | Egypt | Giza 86 | 32.0 | 4.3 |
| | India | Shankar 6 | 31.0 | 4.5 |
| | Turkey | Turkish Cotton | 29.0 | 4.1 |
| Medium-Staple Cotton | USA | San Joaquin | 29.4 | 4.1 |
| | USA | Arizona | 28.6 | 5.0 |
| | USA | Memphis | 27.8 | 4.8 |
| | China | Xinjiang T/129 | 28.6 | 3.9 |
| | Australia | Andy | 28.6 | 4.7 |
| | West Africa | T/Mambo | 27.8 | 4.5 |
| Coarse-Count-Staple Cotton | Pakistan | Afzal | 26.2 | 4.9 |
| | USA | Texas | 26.2 | 3.8 |
| | China | T/427~527 | 27.0 | 4.2 |
| | Peru | Aspero | 26.2 | 6.7 |

Preferably, the water-soluble fiber yarn is a water-soluble PVA yarn or polylactic yarn. Preferably, a fineness thereof is Nos. 50 to 200 in terms of English cotton count. A twist multiplier K is preferably in excess of 0 and not more than 4.0, more preferably 0.5 to 3.8, or further more preferably 1.0 to 3.5, where the twisted multiplier (K) is calculated using (Math. 2]) below.

$$\text{Twist Multiplier } (K) = t/\sqrt{S} \quad \text{[Math. 2]}$$

where t represents the number of twists (number/25.4 mm) and S represents a total yarn count (English cotton count) of the spun yarn and the water-soluble fiber yarn.

Each of the warp ground yarn and the weft ground yarn of the towel cloth may also be any yarn such as an open-end spun yarn, an air-spun yarn, a ring spun yarn, a long-staple conjugate spun yarn, or a fasciated spun yarn. Preferably, a fineness is 10 to 50 S (118 to 591 decitex) in terms of cotton count (S, single yarn) and the twist multiplier K is 3.5 to 4.5, where the twist multiplier (K) is calculated using the foregoing expression (Expression 2). Examples of cotton preferable for the warp ground yarn and the weft ground yarn include the long-staple cotton shown in Table 1 above.

A manufacturing method of the pile yarn for towel cloth according to the aspect of the present invention includes the following steps.

(1) Spinning Step

Using an air spinning machine, an air-spun yarn in which a core fiber is parallel to a yarn axis, while a sheath fiber is twisted in one direction is manufactured.

(2) Water-Soluble Fiber Yarn Winding Step

With a surface of the air-spun yarn mentioned above, a water-soluble fiber yarn is twisted together in a direction reverse to a direction in which the core fiber is twisted. The twist multiplier K during doubling and twisting is preferably in excess of 0 and not more than 4.0. For the doubling and twisting, a typically used yarn twister such as a ring yarn twister is used. Thus, the pile yarn in which the core fiber is twisted in one direction, while the sheath fiber is parallel to the yarn axis is provided.

A towel cloth using the pile yarn described above according to the aspect of the present invention is a pile woven fabric, and the pile yarn described above is the sheath-core spun yarn in which the core fiber is twisted in the one direction, while the sheath fiber is arranged parallel to the yarn axis. The pile woven fabric is not limited but, by way of example, there is a three weft towel structure (three-pick terry motion structure).

A manufacturing method of the towel cloth using the pile yarn for towel cloth according to the aspect of the present invention weaves the pile yarn into the pile woven fabric, and then dissolves the water-soluble fiber yarn on the surface of the pile yarn. The dissolution of the water-soluble fiber yarn is preferably performed when the pile woven fabric is scoured, bleached, and/or dyed.

Preferably, the pile yarn contains 100 mass % of cotton. This allows the pile yarn to show satisfactory water absorbency, satisfactory moisture absorbency, and a satisfactory texture of cotton fibers. The pile yarn is preferably a single yarn or a two-plied yarn. The warp ground yarn is preferably a two-plied yarn containing 100 mass % of cotton fibers. When the pile yarn is a two-plied yarn, fluff dropping is suppressed, and the pile yarn can be woven into a loop pile towel cloth with no sizing. This warp ground yarn is preferably a two-plied yarn obtained by twisting two single ring spun yarns or two single fasciated spun yarns together. The weft ground yarn is preferably a single yarn containing 100 mass % of cotton fibers. As the weft ground yarn, a single ring spun yarn or a single fasciated spun yarn is preferably used. In addition, the pile yarn according to the aspect of the present invention can be used as either a warp pile yarn or a weft pile yarn, but is rather preferably used as the warp pile yarn.

A mass (basis weight) per unit area of the towel cloth according to the aspect of the present invention is preferably in a range of 100 to 1000 g/m$^2$. When the mass is in the foregoing range, the towel cloth is easy to use. Preferably, a thin cloth has a basis weight of 100 to 250 g/m$^2$, a medium-thickness cloth has a basis weight of 250 to 500 g/m$^2$, and a thick cloth has a basis weight of 500 to 1000 g/m$^2$. Note that a cloth having a basis weight of less than 100 g/m$^2$ is unfavorably thin and unbulky, while a cloth having a basis weight of more than 1000 g/m$^2$ is unfavorably too thick and heavy.

The manufacturing method of the towel cloth according to the aspect of the present invention preferably weaves the towel cloth using a weaving machine without sizing each of the pile yarn, the warp ground yarn, and the weft ground yarn. Examples of the weaving machine include an air jet weaving machine, a water jet weaving machine, a shuttle weaving machine, a rapier weaving machine, and the like, and the most efficient air jet weaving machine is preferably used. The air weaving machine can weave the towel cloth at a weaving machine rotation number of 300 to 500 r.p.m.

In the present invention, in terms of a texture, water absorbency, moisture absorbency, and ease of handling of a towel, cotton is most excellent, but it may also be possible to blend cotton with a small amount of such a material as linen, silk, rayon, polyester, nylon, cupra rayon, acetate, or wool. Cotton blended with rayon, cupra rayon, or acetate can absorb moisture, while cotton blended with wool can retain heat. Cotton blended with polyester or nylon can quickly dry.

A woven grey fabric is desized using a liquid flow dyeing machine according to a cotton processing step, and then scoured under usual cotton scouring conditions (kept in a bath of a dilute caustic soda solution added with alcohol ethoxylate at a given temperature of 95 to 98° C. for 50 minutes). Subsequently to the scouring, the cloth is decolored under normal conditions (in a hydrogen peroxide solution at 98° C. for 50 minutes). The scouring and decoloring is referred to also as bleaching. Then, the fabric is dewatered and set in a tenter to be finished (off-white finishing). In this bleaching step also, the fabric is subjected to hydrothermal treatment. By the hydrothermal treatment, the water-soluble fiber yarn is dissolved to be removed.

When dyeing is performed subsequently to the scouring and bleaching, cotton is dyed with a reactive dye (at 60 to 80° C. for 40 minutes). When cotton is blended with polyester fibers, dyeing is performed with a dispersive dye (at 130° C. for 40 minutes). When a cloth including cotton and polyester is to be dyed, it is possible to not only perform plain dyeing on the cloth using two baths thereof, but also dye the cloth in different colors or chambray (in shades of gray) by selectively using the dispersive dye and the reactive dye. In addition, it is also possible to perform print processing on an off-white cloth after subjected to scouring and bleaching. Note that, in a case of a pre-dyed polyester yarn, it is also possible to allow the yarn to provide crimps at the same time as scouring and, by bleaching, dyeing, and weaving the polyester yarn, a yarn-dyed towel cloth can be obtained. In a case of a pre-dyed cotton yarn, by scouring, bleaching, dying, and weaving the cotton yarn, a yarn-dyed towel cloth can be obtained. Thus, the present invention allows commercialization of products with excellent color and design properties through a variety of dyeing processes.

The towel cloth according to the aspect of the present invention is appropriate also for cloth such as a bath towel (after-bath towel), a body towel, a bedding undercoat towel, a face towel, a toweling handkerchief, a sport towel, a bathrobe, or a toweling blanket, clothes, socks, rugs, bedding, or the like.

Referring to the drawings, a description will be given bellow. In the drawings mentioned below, the same reference signs denote the same objects. FIG. 1 is a schematic side view of an air-spun yarn (fasciated spun yarn) 10 to be used in an embodiment of the present invention. In the air-spun yarn 10, a core fiber 11 is parallel to a yarn axis, while a sheath fiber 12 is twisted in one direction.

Figure 2:
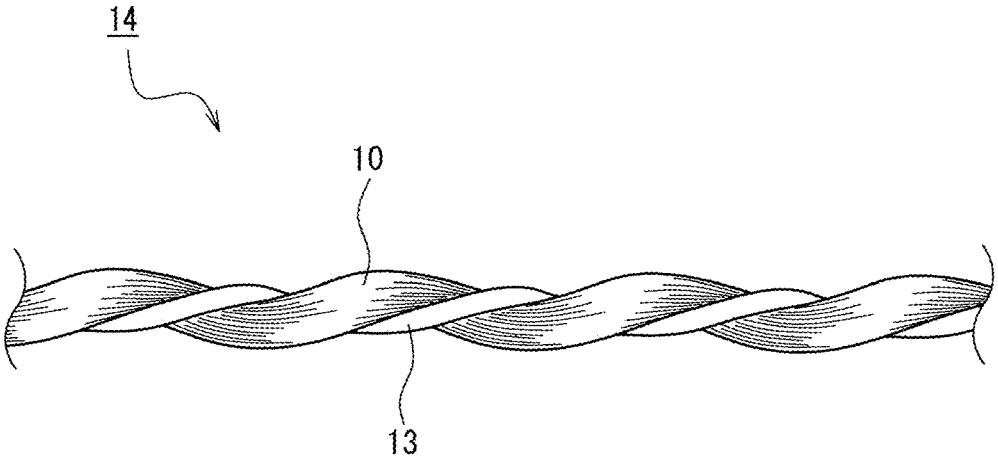
FIG. 2 is a schematic side view of a pile yarn in the embodiment of the present invention.

FIG. 2 is a schematic side view of a pile yarn 14 in the embodiment of the present invention. In the pile yarn 14, the air-spun yarn 10 and a water-soluble fiber yarn 13 are twisted together in an untwisting direction of the sheath fiber 12 mentioned above and the core fiber 11 mentioned above is twisted in a reverse direction as many times as the water-soluble fiber yarn 13 is twisted, while the sheath fiber 12 mentioned above is untwisted as many times as the water-soluble fiber yarn 13 is twisted. In other words, the core fiber 11 mentioned above is twisted in one direction, the sheath fiber 12 mentioned above is arranged parallel to the yarn axis, the water-soluble fiber yarn 13 is wound therearound, and the direction in which the water-soluble fiber yarn 13 is wound is reverse to the direction in which the core fiber 11 is twisted. As a result, the sheath fiber 12 mentioned above is in a non-twisted or softly twisted state.

Figure 3:
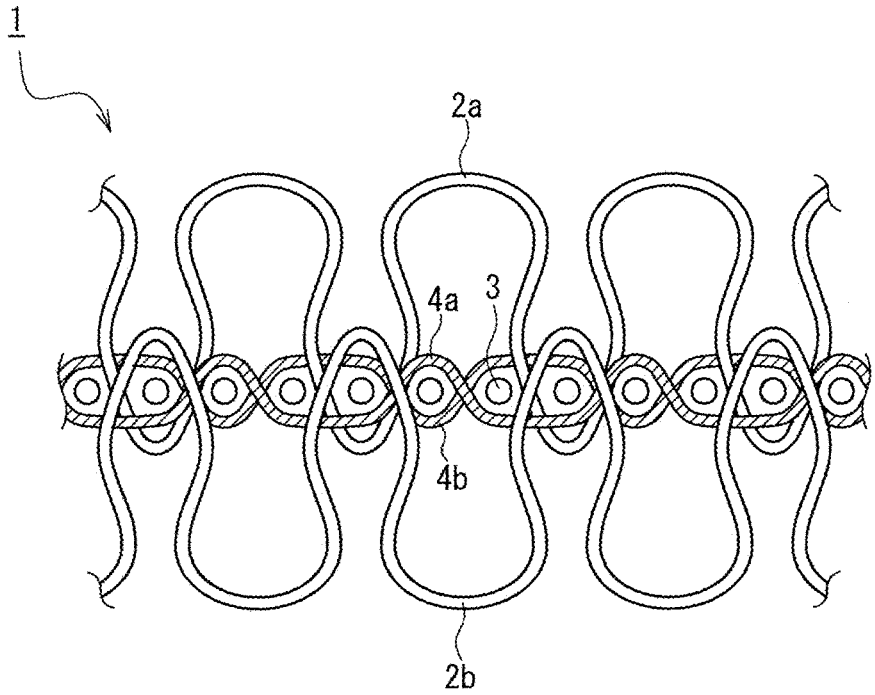
FIG. 3 is a schematic illustrative view of a towel cloth in the embodiment of the present invention.

FIG. 3 is a schematic illustrative view of a towel cloth 1 in the embodiment of the present invention. The towel cloth 1 is configured to include warp pile yarns 2*a* and 2*b*, a weft ground yarn 3, and warp ground yarns 4*a* and 4*b*, and the warp pile yarns 2*a* and 2*b* form a loop pile, while being locked to a ground structure including the weft ground yarn 3 and the warp ground yarns 4*a* and 4*b*. The obtained towel cloth 1 is cut into a predetermined size and subjected to end treatment to result in a towel.

Figure 4:
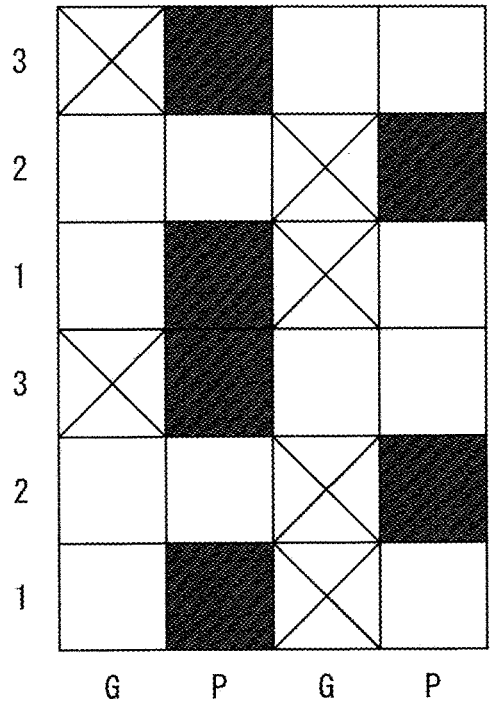
FIG. 4 is a woven fabric structure diagram of the towel cloth in the embodiment of the present invention.

FIG. 4 is a woven fabric structure diagram of the towel cloth in the embodiment of the present invention. The woven fabric structure is a three weft towel structure (three-pick terry motion structure). Every time three weft ground yarns are driven in, the warp pile yarn is crossed therewith once. A warp ground yarn G and a warp pile yarn P are alternately arranged. 1 to 3 for the warp yarns represent an order. In FIG. 4, when viewed from the warp yarns, black squares and crisscrossed squares represent floating yarns, while white squares represent sinking yarns.

EXAMPLES

Using examples, the following will give a more specific description. The present invention is not limited to the following examples.

<Evaluation of Texture of Finished Towel Cloth>

(1) Evaluation of Soft Texture

Softness of a texture is determined as a degree of bulkiness which represents the softness of the texture in terms of a volume per gram of a towel cloth and is given by the following expression. As a value is higher, the texture is softer and more satisfactory. Note that a thickness was measured according to a bulkiness test described in JIS L-1096 (2010) 8.5, and a 1-m square was precisely weighed as a basis weight. Measurement was performed at five positions, and the degree of bulkiness was represented by an average value thereof.

$$\text{Degree of Bulkiness } (cm^3/g) = \text{Thickness (mm)/Basis Weight } (g/m^2) \times 1000$$

(2) Evaluation of Puffy Texture

Using a compression tester KES-G5 (manufacture by KATO TECH CO., LTD.), the towel cloth was compressed at a given speed, and a compression workload WC=(gf.·cm$^2$) was determined. Measurement was performed at five positions, and a WC value was represented by an average value thereof.

The WC value indicates (energy) when the cloth is compressed and, as the value is larger, it is indicated that a towel is more satisfactorily compressed and puffier and favorably gives a fluffier feel.

(3) Evaluation of Washing Durability of Texture

According to the method described in JIS L-0217 (1995), 103, the towel cloth was washed 20 times using a washing machine. After drying, the compression workload WC= (gf.·cm$^2$) mentioned above was measured. The measurement was performed at five positions, and the WC value was represented by an average value thereof. As a difference between the WC values before and after the washing is smaller, the loss of the puffy texture due to the washing is smaller, and the towel cloth is favorably durable.

(4) Evaluation of Drainage in Washing

A length of a towel cloth having a width of 35 cm was cut to weigh 80$g$, and the cut towel cloth was precisely weighed to one decimal place and immersed in water for 20 minutes. Then, the wet towel cloth was collected, centrifugally dewatered in a dewatering bin of the washing machine for 4 minutes, precisely weighed, and a residual moisture rate (%) of the towel cloth was determined using the following expression. As a value is smaller, drainage is more satisfactory. As the drainage is more satisfactory, a speed of subsequent drying tends to be higher. The measurement was performed at three points, and the residual moisture rate was represented by an average value thereof.

Residual = Moisture Rate (%) of Cloth =

(Weight ($W_1$) of Cloth After Immersed in Water and Dewatered)−(Weight ($W_0$) of Cloth Before Immersed in Water)/(Weight ($W_0$) of Cloth Before Immersed in Water)×100

(5) Evaluation of Fluff Dropping of Towel Cloth Due to Washing

Fluff dropping due to washing was measured according to the method described in JIS L0217 (1995), 103. A fluff dropping rate (%) was determined using the following expression and, as a value is smaller, fluff dropping is favorably smaller in amount. The measurement was performed at five points, and the fluff dropping rate was represented by an average value thereof.

Fluff Dropping Rate (%) =

(Weight ($g_1$) of Dropped Fluff After Washing)/(Weight $g_0$) of Towel Before Washing)×100

(6) Evaluation of Water Absorbency (Improved Larose Method)

According to the improved Larose method described in JIS L 1907 (2010), measurement was performed five times, and an average value thereof was determined. A Larose index (water absorption index) was calculated using the following expression.

$$\textit{Larose}\ \text{Index (Water Absorption Index)} = 2545V \times 1411W + 79$$

where V represents a maximum water absorption speed (ml/s) and W represents an amount of absorbed water (ml) when a water absorption speed is maximum. As a value is higher, moisture on skin is more quickly absorbed, and a larger amount of water is favorably absorbed.

(7) Water Absorption Speed (Dropping Method)

A water absorption speed of the towel cloth was measured and evaluated on the basis of a dropping method or burette method described in JIS L 1907 (2010). A test overview is such that one water droplet was dropped from a height of 10 cm onto the towel cloth, a water absorption time (seconds) until a mirror surface of the water droplet disappeared was measured three times, and an average value thereof was determined. As the time is shorter, water absorption is favorably quicker.

<Rewetting Rate Test Method>

A water rewetting rate is described in Japanese Patent No. 6991633 proposed by the present applicant and, in a test method thereof, water droplets are dropped onto a test specimen of a cloth to be absorbed thereby, followed by absorption of moisture with filter paper. The test method evaluates a property of the cloth to retain water as the water rewetting rate and is thus consistent with evaluation of high or low absorbency of water that a person feels while using a fiber cloth such as a towel. As the water rewetting rate is lower, the absorbency of the cloth can be evaluated to be higher and more excellent.

(1) Test Environment and Other Conditions

A test environment was set such that, under a standard state environment, a temperature was 20±4° C. and a relative humidity was 65±4% RH.

As the filter paper, filter paper that had been stored at a temperature of 20±4° C. and a relative humidity of 65±4% RH under the standard state environment for 24 hours or longer was used.

As the test specimen, a test specimen that had been stored at a temperature of 20±4° C. and a relative humidity of 65±4% RH under the standard state environment for 24 hours or longer was used.

As the water to be dropped, water at a temperature of 20±15° C. (5 to 35° C.) was used.

(2) Operation Procedure

A size of the test specimen of the fiber towel cloth was set to be 10 cm long and 10 cm wide. The test specimen was placed on a sample stage.

As the filter paper, filter paper made of JIS P 3801 Class 1 standard α-cellulose and having a diameter of 110 mm and a thickness of 0.22 mm was used, and a weight of the filter paper was measured. As the filter paper, filter paper manufactured by ADVANTEC CO., Ltd. under the trade name of "Circular Quantitative Filter Paper No. 1" was used.

0.8 ml of water was measured into a pipette, dropped onto the test specimen, and absorbed by the test specimen after 5-second waiting.

The filter paper was placed, and a 1.3 kg (1274 Pa) load was placed thereon.

After 5-second waiting, the load was removed.

A weight of the filter paper after water absorption was measured.

(3) Calculation of Water Rewetting Rate

The water rewetting rate was calculated using the following expression.

$$W = [(B - A)/A] \times 100$$

where W represents the water rewetting rate (%), A represents a weight (g) of the filter paper before the measurement, and B represents a weight (g) of the filter paper after the water absorption. The water wetting rate having a lower numerical value is more excellent.

<Pile Uprightness Property>

Using an optical microscope, a photograph (X30 magnification) of a side surface of a pile portion of the tower cloth was observed.

Example 1

1. Fibers in Use (1) Warp Pile Yarn

As a warp pile fiber, cotton having a staple length of 31.3 mm and a micronaire of 4.4 μg/inch was used to obtain a sheath-core-type swirling-air-spun yarn having a cotton number of 40S and using 100% combed cotton with a sliver thickness of 320 Gr/6 yd (FIG. 1). A center portion (core) of the spun yarn had 20 to 30% of a parallel fiber portion, while an outer layer portion (sheath) thereof had 80 to 70% thereof. Then, the swirling-air-spun yarn mentioned above, a No. 80 single yarn, and a spun yarn of water-soluble PVA having a staple length of 38 mm were twisted together using a ring yarn twister. The twist multiplier K during doubling and twisting was 2.7, a direction of twisting was a direction in which a sheath fiber (wound fiber) of the swirling-air-spun yarn mentioned above was untwisted, and the sheath fiber was in a substantially non-twisted state (FIG. 2).

(2) Warp Ground Yarn

Cotton having a staple length of 31.3 mm and a micronaire of 4.4 μg/inch was used, and a ring spun yarn containing 100 mass % of cotton fibers and a two-plied yarn (394 decitex) having a cotton count of 30S were used (30S/2).

(3) Weft Ground Yarn

Cotton having a staple length of 31.3 mm and a micronaire of 4.4 μg/inch was used, and a ring spun yarn containing 100 mass % of cotton fibers and a single yarn (295 decitex) having a cotton count of 20S were used (20S/1).

2. Weaving of Towel Cloth

The warp pile yarn, the warp ground yarn, and the weft ground yarn were not sized (with no sizing) and set to an air weaving machine and, at 400 r.p.m., a loop pile woven cloth illustrated in FIG. 3 and FIG. 4 was manufactured. The warp pile yarn was fed at a ratio of 8.3 times that of the warp ground yarn. Thus, a double-sided pile cloth having a warp yarn density of 60/2 inches, a weft yarn density of 54/inch, and a pile length of 1.18 cm was manufactured. After scoured and bleached (desizing was unnecessary), the pile woven cloth was placed in a tenter and subjected to thermal treatment to be finished. A mass (basis weight) per unit area of the cloth was 313 g/m$^2$.

3. Scouring/Finishing Process for Tower Cloth

Then, on the basis of cotton processing, a grey fabric was scoured according to normal practice by being kept in a 98° C. dilute caustic soda bath added with alcohol ethoxylate for 50 minutes.

Subsequently, according to normal practice, the grey fabric was bleached by being kept in a 98° C. hydrogen peroxide bath for 50 minutes and set in the tenter at 135° C. to be finished (off-white finishing). A pile length was 1.18 cm.

Comparative Example 1

A towel was woven in the same manner as in Example 1 except that a ring spun yarn using 100% cotton and a single yarn having a cotton count of 40S were used as warp pile yarns and sized, and then the towel was desized.

Results of the following were shown in Table 2.

TABLE 2

Figure 5:
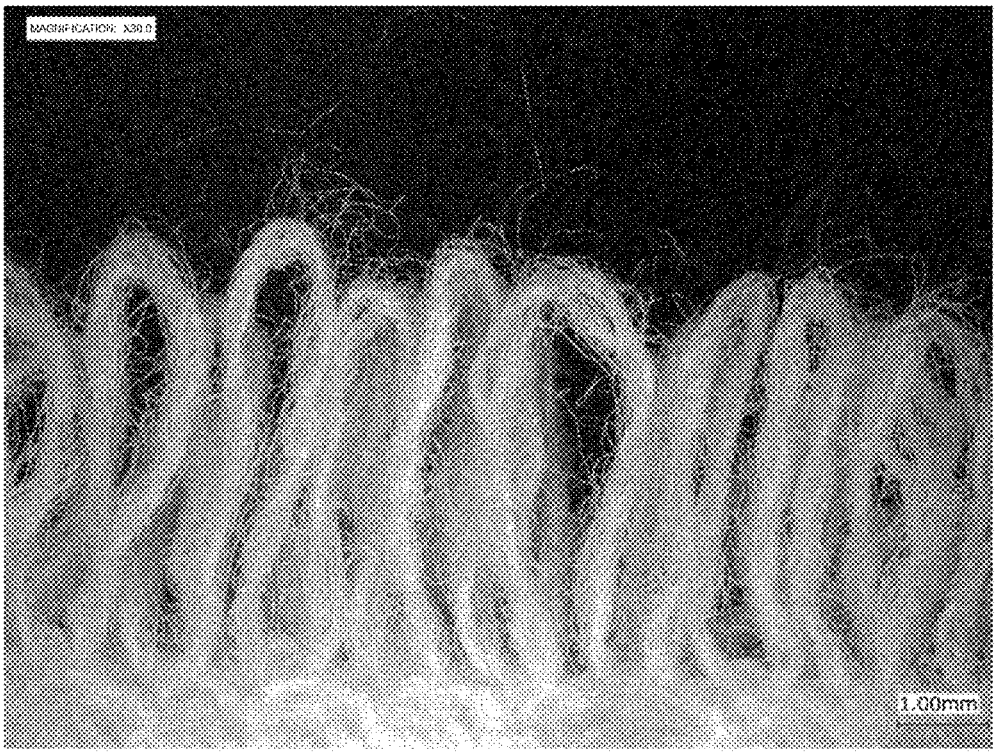
FIG. 5 is a photograph (X30 magnification) of a side surface of a pile portion of a towel cloth before washing in Example 1 of the present invention.
Figure 6:
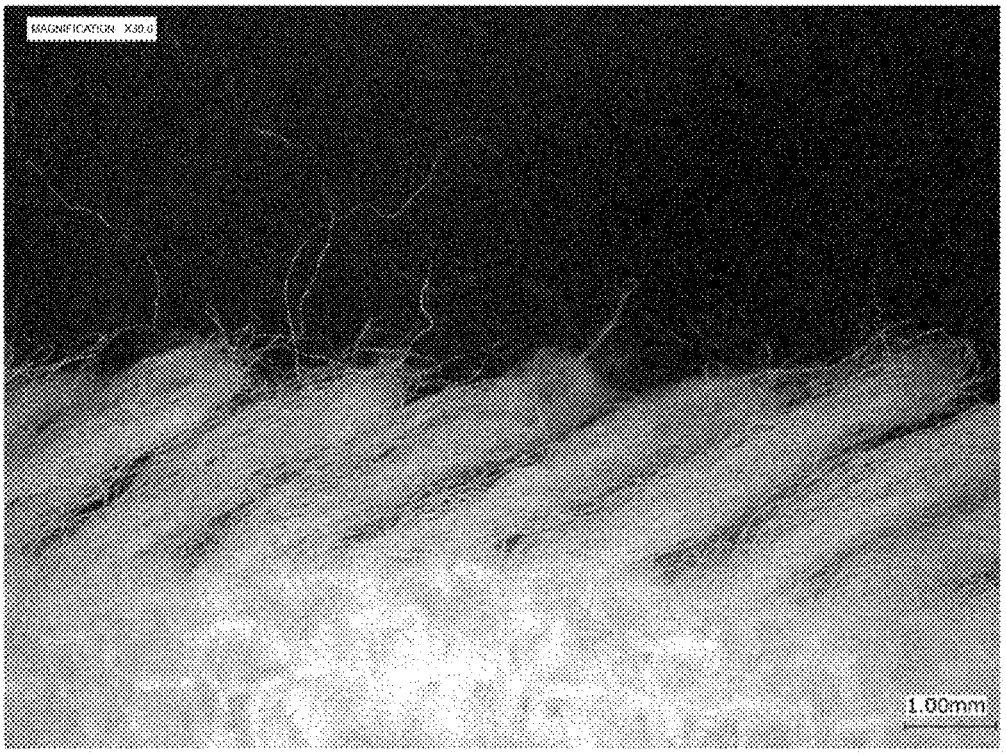
FIG. 6 is a photograph (X30 magnification) of a side surface of a pile portion of a towel cloth before washing in Comparative Example 1.
Figure 7:
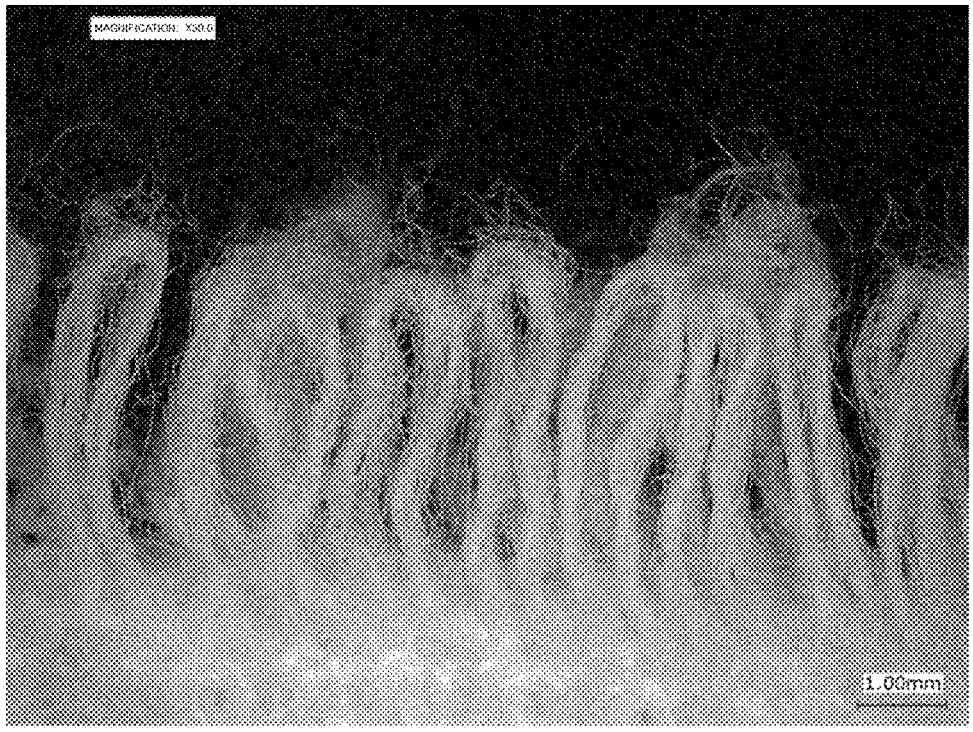
FIG. 7 is a photograph (X30 magnification) of the side surface of the pile portion of the towel cloth after 20 washes in Example 1 of the present invention.
Figure 8:
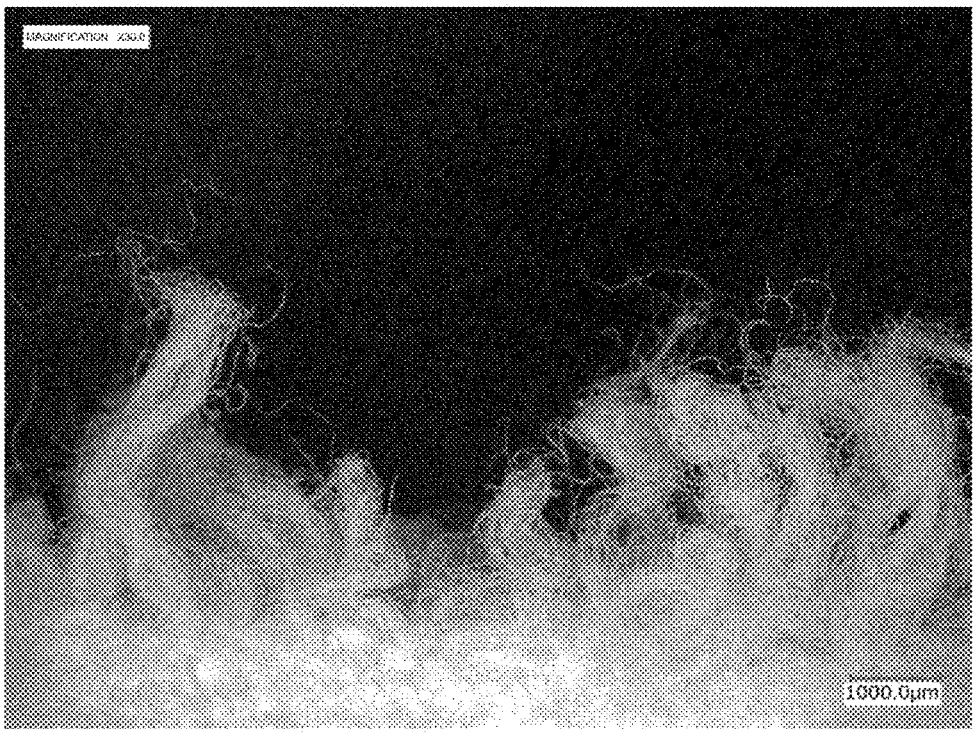
FIG. 8 is a photograph (X30 magnification) of the side surface of the pile portion of the towel cloth after 20 washes in Comparative Example 1.

| | Example 1 | Comparative Example 1 |
|---|---|---|
| Basis Weight (g/m$^2$) | 313 | 313 |
| Pile Lenth (cm) | 1.18 | 1.18 |
| Material | Cotton 100% | Cotton 100% |
| Degree of Bulkiness (cm$^3$/g) | 15.45 | 10.37 |
| Compression Workload WC Before Washing (gf. cm$^2$) | 5.576 | 3.172 |
| Compression Workload WC After 20 Washes (gf. cm$^2$) | 5.492 | 2.601 |
| Drainage in Washing, Residual Moisture Rate (%) | 66 | 79 |
| Fluff Dropping Rate (%) | 0.0110 | 0.1244 |
| Improved Larose Method, Water Absorption Index | 815 | 688 |
| Dropping Method, Water Absorption Speed (Seconds) | Less than 1 | Less than 1 |
| Rewetting Rate (%) | 11.7 | 22.4 |
| Photograph of Side Surface of Pile Yarn Before Washing | FIG. 5 | FIG. 6 |
| Photograph of Side Surface of Pile Yarn After 20 Washes | FIG. 7 | FIG. 8 |

As is obvious from Table 2, the towel cloth in Example 1 has the following advantages over that in Comparative Example 1.

(1) Having less fluff dropping
(2) More bulky
(3) Less likely to lose puffiness after washing, i.e., less likely to be deteriorated by washing
(4) Having less rewetting and permitting comfortable wiping experience

INDUSTRIAL APPLICABILITY

A towel cloth according to an aspect of the present invention is appropriate also for cloth such as a bath towel (after-bath towel), a body towel, a bedding undercoat towel, a face towel, a toweling handkerchief, a sport towel, a bathrobe, or a toweling blanket, clothes, socks, rugs, bedding, or the like.

REFERENCE SIGNS LIST

1 Towel cloth
2*a*, 2*b*, 10, P Warp pile yarn
3 Weft ground yarn
4*a*, 4*b*, G Warp ground yarn
10 Air-spun yarn (fasciated spun yarn)
11 Core fiber
12 Sheath fiber
13 Water-soluble fiber yarn
14 Warp pile yarn

What is claimed is:

1. A pile yarn for towel cloth which is a pile yarn to be used for a towel cloth including a pile yarn, a warp ground yarn, and a weft ground yarn, wherein the pile yarn is a sheath-core spun yarn in which a core fiber is twisted in one direction, while a sheath fiber is arranged parallel to a yarn axis, and the sheath-core spun yarn is twisted together with a water-soluble fiber yarn and a direction in which the water-soluble fiber yarn is wound is reverse to the direction in which the core fiber is twisted.

2. The pile yarn for towel cloth according to claim 1, wherein the pile yarn is an air-spun yarn.

3. The pile yarn for towel cloth according to claim 1, wherein the core fiber and the sheath fiber are switched to each other by migration.

4. The pile yarn for towel cloth according to claim 1, wherein the water-soluble fiber yarn is a water-soluble PVA yarn or a polylactic yarn.

5. The pile yarn for towel cloth according to claim 1, wherein a twist multiplier K for the sheath-core spun yarn and the water-soluble fiber yarn is in excess of 0 and not more than 4.0, where the twist multiplier (K) is calculated using expression (Math. 1) below:

$$\text{Twist Multiplier } (K) = t/\sqrt{S} \quad \text{[Math. 1]}$$

where t represents the number of twists (number/25.4 mm) and S represents a total yarn count (English cotton count) of the spun yarn and the water-soluble fiber yarn.

6. A manufacturing method of the pile yarn for towel cloth according to claim 1, the pile yarn being manufactured by an air spinning machine as an air-spun yarn in which a core fiber is parallel to a yarn axis, while a sheath fiber is twisted in one direction, and a water-soluble fiber yarn being twisted together with a surface of the air-spun yarn in a direction reverse to a direction in which the core fiber is twisted, to twist the core fiber in one direction, while the sheath fiber is untwisted to be parallel to the yarn axis.

7. A towel cloth using the pile yarn for towel cloth according to claim 1, wherein the towel cloth is a pile woven fabric, and the pile yarn is a sheath-core spun yarn in which a core fiber is twisted in one direction, while a sheath wire is arranged parallel to a yarn axis.

8. A manufacturing method of a towel cloth using the pile yarn for towel cloth according to claim 1, wherein, after the pile yarn is woven to a pile woven fabric, a water-soluble fiber yarn on a surface of the pile yarn is dissolved.

9. The manufacturing method of the towel cloth according to claim 8, wherein the dissolution of the water-soluble fiber yarn is performed when the pile woven fabric is scoured, bleached, and/or dyed.

* * * * *